US005170380A

United States Patent [19]

Howard et al.

[11] Patent Number: 5,170,380

[45] Date of Patent: Dec. 8, 1992

[54] MEDICATION CONTAINER HOLDING DEVICE INCATING USAGE TIME

[75] Inventors: James M. Howard, Dover; Ralph DeVito, Stanhope; Bart J. Zoltan, Old Tappan, all of N.J.

[73] Assignee: Wheaton Holding, Inc., Wilmington, Del.

[21] Appl. No.: 627,328

[22] Filed: Dec. 14, 1990

[51] Int. Cl.[5] ..... G04B 47/00; A47B 67/02

[52] U.S. Cl. ..... 368/10; 221/2; 221/15

[58] Field of Search ..... 368/10, 11, 72–74, 368/82, 276; 221/2, 3, 15

[56] References Cited

U.S. PATENT DOCUMENTS

| | | | |
|---|---|---|---|
| 3,911,856 | 10/1975 | Ewing | 116/121 |
| 4,034,757 | 7/1977 | Glover | 128/260 |
| 4,038,937 | 8/1977 | Möe | 116/121 |
| 4,158,411 | 6/1979 | Hall et al. | 206/531 |
| 4,223,801 | 9/1980 | Carlson | 221/3 |
| 4,275,384 | 6/1981 | Hicks et al. | 340/309 |
| 4,295,567 | 10/1981 | Knudsen | 206/534 |
| 4,361,408 | 11/1982 | Wirtschafter | 368/10 |
| 4,419,016 | 12/1983 | Zoltan | 368/10 |
| 4,660,991 | 4/1987 | Simon | 368/10 |
| 4,725,997 | 2/1988 | Urquhart et al. | 368/10 |
| 4,725,999 | 2/1988 | Tate | 368/10 |
| 4,731,765 | 3/1988 | Cole et al. | 368/10 |
| 4,768,176 | 8/1988 | Kehr et al. | 368/10 |
| 4,768,177 | 8/1988 | Kehr et al. | 368/10 |
| 4,858,207 | 8/1989 | Buchner | 368/10 |
| 4,912,687 | 3/1990 | Treeby | 368/10 |
| 4,926,572 | 5/1990 | Holmes | 40/448 |
| 4,939,705 | 7/1990 | Hamilton et al. | 368/10 |
| 5,020,037 | 5/1991 | Raven | 368/10 |
| 5,099,463 | 3/1992 | Lloyd et al. | 368/10 |

*Primary Examiner*—Vit W. Miska
*Attorney, Agent, or Firm*—Thomas A. Lennox

[57] ABSTRACT

A holding device for medication containers of essentially any size or shape provides the patient with the last time the medicine was taken and includes a housing with a cylindrical cup shape opening with a micro switch member extending through an access opening into the cavity form one side of the opening. Individual positioning devices in the form of vertical open cylindrical tubes are sized to fit particular containers with the cylinders positioned proximate the switch member with an opening to allow the switch member to extend into the cylindrical bore opening. A bushing and interlocking tab index the position of each cylindrical tube in the correct position each time the positioning device is inserted into the base section of holding device. The sensor signal that a container is placed in the base is used to provide through numerical display the time the last medication was taken, the elapsed time since that dose and the number of times the medication was accessed in one day. A settable alarm is provided to alert the patient as to the next time to take the medicine.

26 Claims, 5 Drawing Sheets

MEDICATION CONTAINER HOLDING DEVICE INCATING USAGE TIME

BACKGROUND OF THE INVENTION

This invention relates to control of medication use and in particular to a device and method to aid in patient compliance with a prescribed dosage of medication.

The problem of a patient adhering to a dosage scheme for medicine prescribed by a physician is acute. Medicine is always prescribed with a particular dosage taken at certain intervals taken during the day and sometimes into the night. The dosage requirements are complicated by varying starting times during the day. While it is desirable that the patient stay on a regular regimen, for example starting the medicine taking at a certain time, it is common for the patient to be a little early or a little late when starting thus changing the regimen from day to day. Further, it is known that persons are prone to forget not only whether the medicine has been taken, but also when the last dose was taken. As a consequence, the patient frequently takes medicine on a more frequent interval than prescribed or on a longer interval such that the effectiveness of the medicine and the continuous level of medication carried through the body system is interrupted. The failure to adhere to the prescribed dosage may result in complications or at the minimum interfere and make less effective the medicine prescribed. The problem of taking medicine at the proper times and in the proper dosages is even more serious with the aged and infirm. Needless to say, a person who is seriously ill has a more difficult time adhering to the prescription and keeping track of the time when the last dose was taken and when the next dose is due. In addition, there is a certain percentage of individuals, regardless of age or infirmity, that are not careful in keeping track of the time when the dose of a medicine was last taken. Further, since taking the dose of medicine is extremely repetitive, it is difficult to remember whether the medicine was actually taken, even if it was only a few hours ago. A further complication of failing to be sure that the last dose was taken or when the next dose is due is the mental strain and worry asociated with the problem. Particularly for aged persons, such concern can weigh heavily on their confidence and emotional well being.

This problem is well known and there have been a number of attempts in the prior art to aid the patient in complying with drug therapy. Such a device is described in U.S. Pat. No. 4,419,016 to BART J. ZOLTAN describing a time keeping device incorporated into a typical container for medicinal products. Specifically, the device is provided either as a separate element or as part of the cap or cover of the medicine container. While it is suggested that the ZOLTAN device need not be integral or part of the medicine container and can be utilized as a reusable item with fresh containers, all of the devices are directed to the closure mechanism and register the time when the closure was last closed. A time keeping device displays the time and day of the week when the container was last opened by the patient and continues to display that same time, even after closing the container to serve as a reminder to the patient when the medicine was last taken. The ZOLTAN time keeping device is also provided with settable alarms to visually or audibly alert the patient as to when the next dose is to be taken. A problem with the ZOLTAN device is the multiplicity of the size of pharmaceutical containers and the various designs and construction of such containers. It is therefore difficult to incorporate the ZOLTAN device with a multiplicity of container closures thus limiting the scope of its use.

Other prior art devices include dispensing containers in which each individual dosage unit is provided in a separate compartment with each compartment identified as to a particular time or numerical sequence. Such containers are described in U.S. Pat. Nos. 4,038,937; 4,158,411; and 4,295,567.

Other devices have relied on calendar indicators and timers which can be set and combined with individual compartments for the dosage unit of the medication to be taken. U.S. Pat. No. 4,911,856 discloses such a device. At the prescribed time, the user rotates the cap to uncover the desired compartment for access to the medication. A date selector and timer which can be set for the period to provide an indication as to the next time to use the medication is included.

U.S. Pat. No. 4,034,757 describes a container with a compliance monitor. This container includes two compartments, one for the medication and the other for the recording circuitry. When the cap is removed and when the container is inverted, the circuitry is activated with the data being stored in addressable memory. The data is read by a clinician.

Another device is described in U.S. Pat. No. 4,223,801 as an automatic periodic drug dispensing system. This system includes a multi-compartment container which is color coded corresponding with dots on the face of a watch to indicate when the medication should be taken. Another device described in the same patent includes a timer integral with the container which signals when the medication should be taken as well as a switching device activated by the user to eliminate the signal and open the compartment to access the medication. Also included is a device which relies on a paging signal from a UHF radio received by crystals in the device to register the particular regimen prescribed for the patient.

All of these devices have the disadvantage of incorporating the medication control with the dispenser. Thus, the supplier of the controlling device must either supply the dispenser or design the controlling device so that it fits a particular dispenser or group of dispensers. None of these devices satisfy the need to alert the patient to take medicine from virtually any size or shape container or attain the objects described hereinbelow.

SUMMARY OF THE INVENTION

It is an object of the present invention to provide a device that aids the patient in adhering to a drug taking regimen utilizing a base into which any one of a multiplicity of common and standard pharmaceutical containers can be placed.

It is further object of the present invention to provide such a device that registers the last time that the pharmaceutical container was removed from the base and utilizing that time to determine the next time when the next dose of medicine is to be taken and alerting the patient as to that time with a suitable alarm.

It is a particular object of the present invention to divorce the function of indicating when the last dosage of medicine was taken from the operation of the medication container and specifically from the closure of that container.

It is a specific object of the present invention to provide a device that aids in the control of medication regimen functioning with a wide variety of different sizes and shapes of standard pharmaceutical vials and bottles.

It is a specific object of the present invention to avoid the necessity of a child resistent feature being incorporated into and with the device alerting the patient that medication is due.

It is an object of the present invention to provide a device that aids in drug taking regimen that is suitable for use in the home or in an institutional care-giver environment.

It is a further object of the present invention to provide a device which may be used together with and in concert with additional identical devices to make a neat and simple array of all the medications and the time control of the medicine regime for a plurality of differnt medicines with different time schedules.

An aspect of the invention is a holding device for medicine containers providing information as to when the medicine was taken to aid a patient to take medicine in a timely manner. The device includes a housing that includes a base section having an opening of a sufficient shape and size to receive a medicine container in the base section and be supported therein. The device further includes time keeping means in the housing to keep correct time and display means on the housing to display the time when the last dosage was taken. The device also includes sensor means in the housing to sense when a container is placed in the opening of the housing and to provide a signal of the condition that a container has been placed in the housing. The device further includes circuit means to transmit the signal to signal processing means electrically connected with the time keeping means to receive the signal from the sensor means, to register the time when the medicine container was last placed in the base section, and to activate the display means to display said time.

It is preferred that the sensor means sense the container at a location in the opening and the device further include a positioning means to position the container inserted in the opening such that a portion of the container must be in said location regardless of the size or shape of the container. It is further preferred that the sensor means include a switch member extending into the opening to said location. It is also preferred that the positioning means include a guide member, preferably a plurality of guide members, defining an inside bore with an inside size to receive a specific sized and shaped container, access means through the guide member to allow access of the sensing means to said location when the guide member is inserted in the opening of the base section, and alignment means to align the guide member inserted into the opening to allow the sensing means to reach said location through access means. It is further preferred that the guide member include a cylindrical tube having an inside bore size to receive a specific sized container. It is also preferred that the positioning means include a plurality of cylindrical tubes each having an inside size to receive a different specific sized or shaped container and an aperture into the inside of the tube to receive the switch member, and alignment means to hold any of the tubes inserted into the opening to align the aperature to allow the switch member to reach said location. It is further preferred that the signal processing means further include means to determine the time interval since the medicine container was last placed in the housing and to cause the display means to display same. It is further preferred that the signal processing means further include means to determine the number of times the medicine container was placed in the housing within a chosen period of time and to cause the display means to display same. It is further preferred that the time keeping means further include alarm means to allow the setting of the time when the medicine should next be taken and indicating to the patient when that time is reached. It is also preferred that sensor means in the base section sense at a location in the opening when a container is placed in the opening of the base section and that the device further include positioning means to position the container inserted in the opening such that a portion of the container must be in said location regardless of the size or shape of the container. It is further preferred that the alignment means include an integral bushing member from which the guide member depends and through which a bore opening is aligned with the inside bore of the buide member.

Another aspect of the invention is a method to aid a patient to take the medicine in a timely manner providing information as to when the medicine was taken. The method includes providing the device as above, inserting a medicine container into the housing in the housing after taking the medicine, and reading the time on the display means as being when the medicine was last taken. It is preferred that the method further include providing the positioning means as above, inserting the positioning means into the opening of the housing prior to inserting the container, and inserting a medicine container into the inside bore in the guide member after taking the medicine. It is more preferred that the method further include providing a plurality of guide members each defining an inside bore with a different inside size or shape to receive a different specific sized or shaped container, and choosing a guide member having an inside bore corresponding to the medicine container to be used.

DESCRIPTION OF PREFERRED EMBODIMENTS

Figure 1:
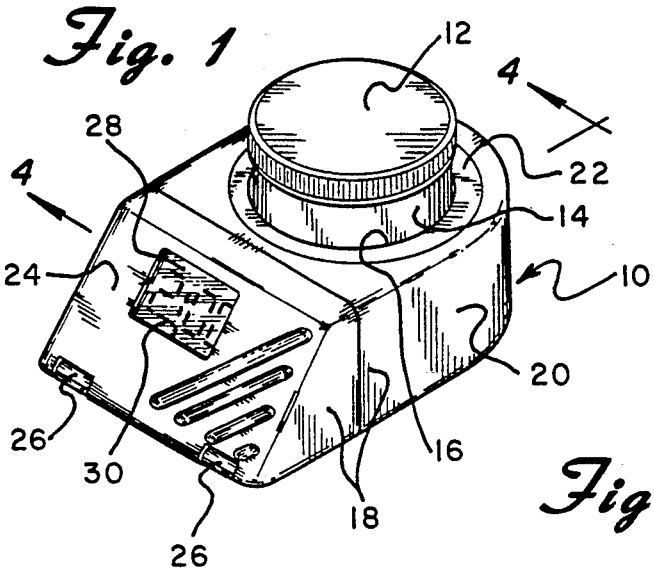
FIG. 1 is a perspective view of a device of the present invention with a pharmaceutical container inserted therein.

Device 10 for holding medicine containers that provides information as to when the medicine was taken to aid the patient to take the medicine in a timely manner is illustrated in FIG. 1. Container 12 is a typical medicine container with a cylindrical body 14 which fits through the bore opening 16 of bushing 22 which interfits into a opening into base section 20 of housing 18. Cover 24 is hingeably attached swinging frontwardly and downwardly to expose the controls of the timing mechanism enclosed in housing 18. A numeric display shows through transparent glazing 28 spanning window frame 30 of cover 24. With the device in this condition, the time when container 12 was last placed in base section 20 can be viewed. Additional information is accessible from the electronic device in the housing.

Figure 2:
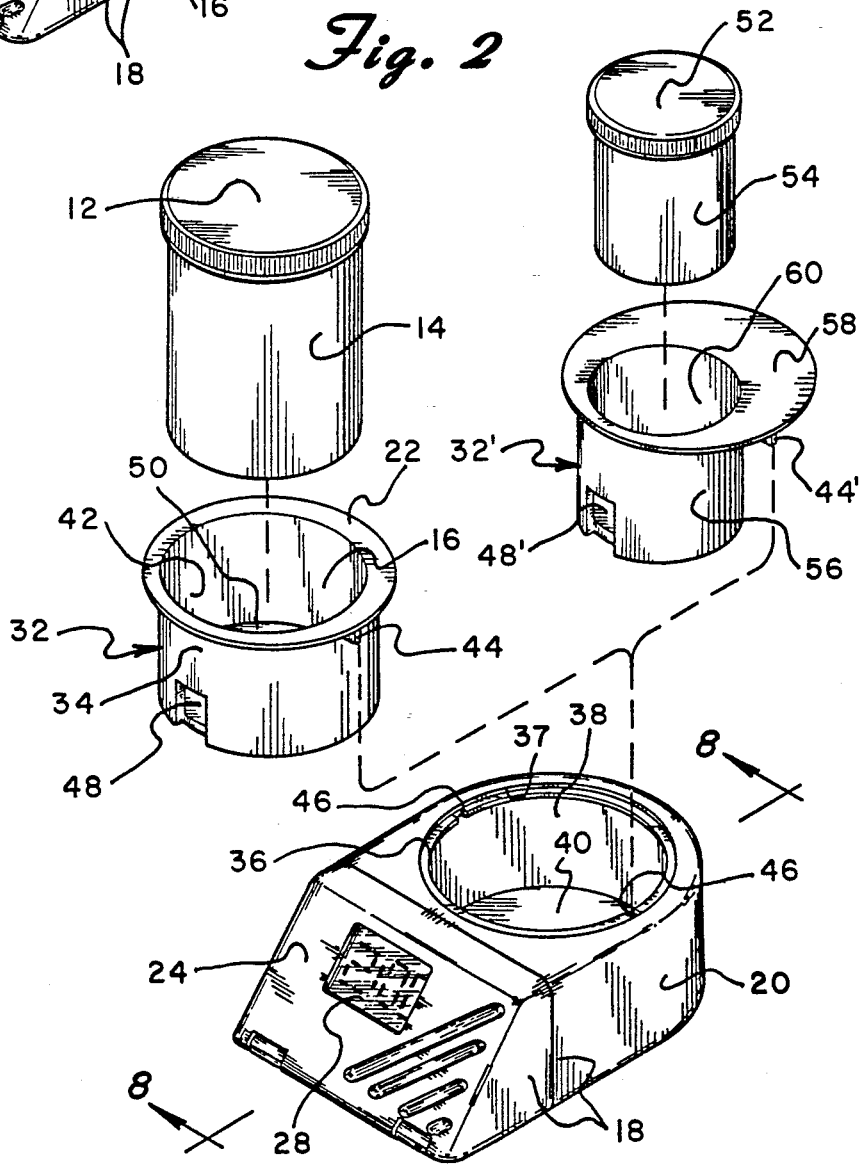
FIG. 2 is a partially exploded perspective view of the device illustrated in FIG. 1 also showing a second bushing configuration to receive a smaller pharmaceutical container indicating how each is inserted into the device.

In FIG. 2 the container and positioning devices 32 and 32' have been exploded from base section 20 of housing 18. Positioning device 32 is an integral molding of thermoplastic polymer with cylindrical tube 34 depending downwardly from bushing 22 which extends horizontally outwardly from the top of tube 34 to engage and rest on shoulder 36 extending inwardly from the periphery of the walls of base section 20 surrounding opening 38 which opens vertically downwardly into housing 18 terminating at floor panel 40. Positioning device 32 has inside vertical bore opening 16 which is bounded by inside surface 42 of tube 34. The dimensions of the inside surface 42 are chosen to receive a particular sized pharmaceutical container 14 and provide a close or even a snug fit. Positioning device 32 and in fact each of additional positioning devices for other specific sized containers are aligned by inserting vertical tab members 44, one of which is shown in this view with another identical tab member extending outwardly from the upper edge of tube 34 in the opposite direction. They are located one hundred eighty degrees from each other. Alignment tabs 34 engage in slots 46 cut through shoulder 36 on opposite sides of opening 38 so that when device 32 is inserted into opening 38, the position of bore opening 16 is positioned such that one side is proximate the side of opening 38 nearest the electronic and mechanical mechanisms in housing 18 located in the frontward section. Access aperture 48 opens through the side wall of cylindrical tube 34 proximate bottom 50 of device 32 and when positioned with tabs 44 inserted in slots 46, it is positioned to provide access for a sensing device extending through the aperture into bore opening 16 to a chosen location. Also illustrated in FIG. 2 is a second positioning device designated 32'. This device is constructed to receive and position smaller pharmaceutical container 52 which includes cylindrical body 54 which is substantially smaller in diameter than that of body 14. Device 32' is again an integrally molded part with cylindrical tube 56 depending downwardly from flange 58 which is identical in its outside diameter to that of flange 22 such that it fits into circular opening 37 and rests on shoulder 36 with alignment tabs 44' engaging slots 46 to align device 32' in the correct radial position. In this embodiment, bore opening 60, it being the inside of cylindrical tube 56 is sized to snugly receive body 34 of container 52. Opening 60 and depending tube 56 are off set from the center of bushing 58 and thus off set from the center of opening 38 so that the edge of bore opening 60 is proximate the edge of bushing 60 closest to the front of device 10. This positioning places the nearest side of cylinder 56 and access aperture 48 in exactly the same position with respect to base 20 as is obtained with device 32 and aperture 48. The fit of the container into device 32 is important to the extent that the size and shape of bore opening 16 for device 32 or bore 60 or device 32' must be sufficient to force the position of container to occupy the space of the chosen location of the sensing means. Thus the fit need not be snug or even close so long as the primary condition is met.

Figure 3:
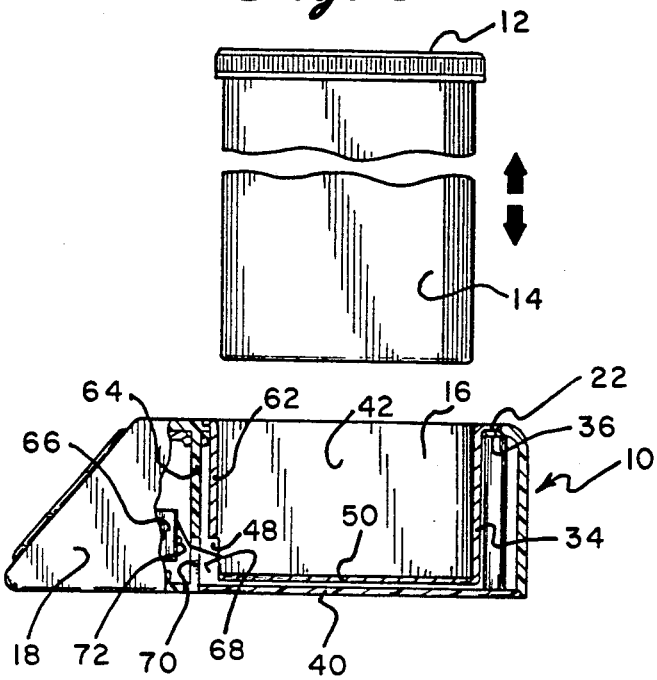
FIG. 3 is a right side elevational view thereof partially cut away to show the bushing inserted for the larger size container.
Figure 4:
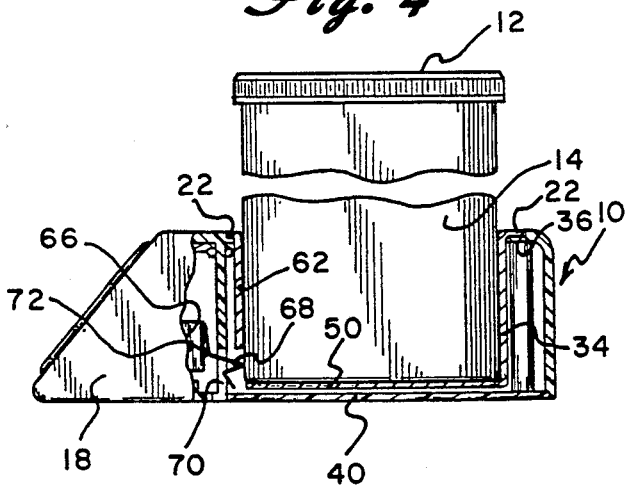
FIG. 4 is a view identical to that of FIG. 3 with the pharmaceutical container inserted into the housing of the device.
Figure 5:
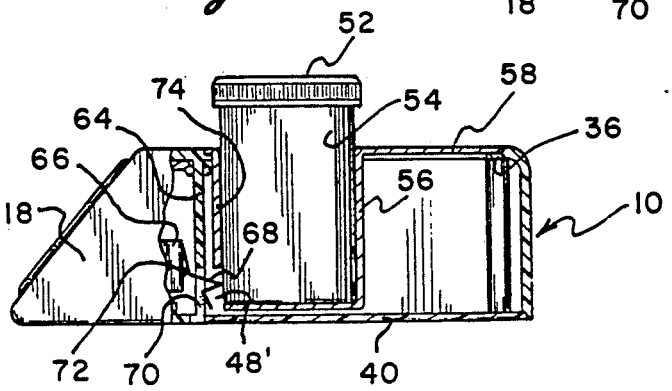
FIG. 5 is a right side elevational view of the device illustrated in FIG. 1 partially cut away to show the insertion of a bushing sized to received a smaller sized pharmaceutical container with the container inserted therein.

As shown in FIGS. 3 and 4, device 10 is equipped with positioning device 32 sized to receive body 14 of container 12 into bore opening 16 to rest on bottom 50 as a snug fit on the inside of cylindrical tube 34. Bushing 22 rests on shoulder 36 and is aligned so that access aperture 48 is in a position opening to and facing the front portion of housing 18 that houses the mechanical and electrical components of device 10. Access aperture 48 opens through side wall 62 which is proximate to and abuts interior vertical wall 64 of housing 18. Micro switch 66 is positioned on the frontward side of interior wall 64 with switch member 68 extending through opening 70 which is adjacent to and aligned with access aperture 48. As illustrated in FIG. 3, when container 12 is not in base section 20, spring switch member 62 extends through openings 70 and 68 into bore opening 16 and past the interior surface of side wall section 62 of cylindrical wall 34 to the chosen location. As shown in FIG. 4, when container 12 is inserted into opening 16 a section of body 14 must of necessity fill the chosen location previously occupied by switch member 68 forcing it back through bore opening 16 causing it to bend and make electrical connection with contact 72 closing the circuit and signalling the presence of container 12 in base section 20. Also shown in this view is base floor panel 40 attached and covering the bottom of housing 18. In FIG. 5, positioning device 32' is inserted into opening 16 with bushing 58 resting on shoulder 36 and with the engagement of alignment tabs 44', cylindrical tube 56 is positioned to the front side such that wall section 74 of that tube is positioned frontwardly and adjacent to interior wall 64 through which opening 70 allows switch member 68 to extend into opening 16 and when container 52 is not present into bore opening 60. As illustrated in FIG. 5, with container 52 in base section 20 with body 54 snugly fitted into cylindrical tube 56 the location of switch member 68 has been displaced pushing it forwardly to close electrical contact and indicate that container 52 has been placed in base section 20.

Figure 6:
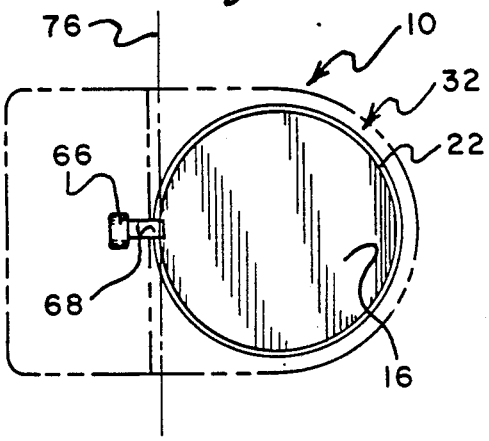
FIG. 6 is a diagram illustrating top views of the device illustrated in FIG. 1 showing various sized bushings to receive various sized pharmaceutical containers.

The diagrams of FIG. 6 illustrate how the positioning devices vary in size and shape to receive and compensate for the varying sizes of containers. Although not shown, it should be clear that varying shapes can also be accommodated. There is no reason why a shape other than circular cannot be provided for in the bore opening of the positioning device. For example, although not illustrated, the oblong shape of a pharmaceutical bottle containing a liquid medicine may utilize an oblong shaped bore in the positioning device with one edge of the shape being positioned proximate the front edge of opening 38 so that the bottle cannot be inserted into base section 20 without engaging switch member 68 and registering the presence of the bottle in the device.

Figure 6A:
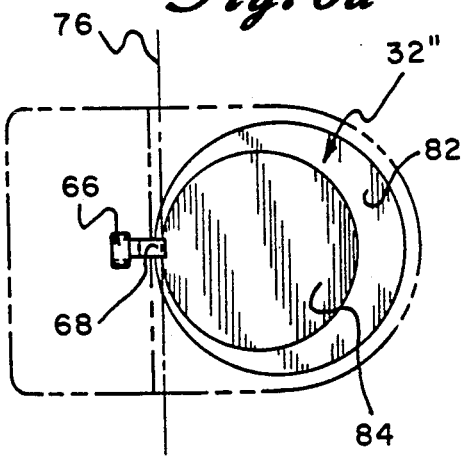
Figure 6B:
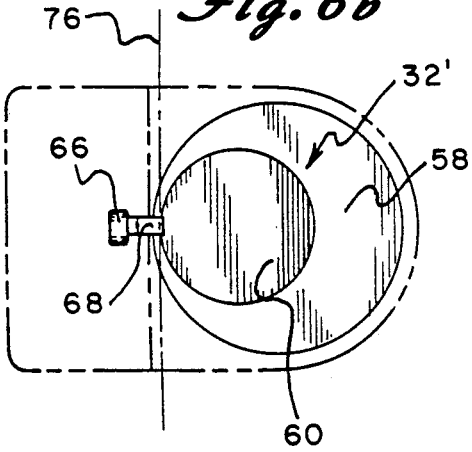
Figure 6C:
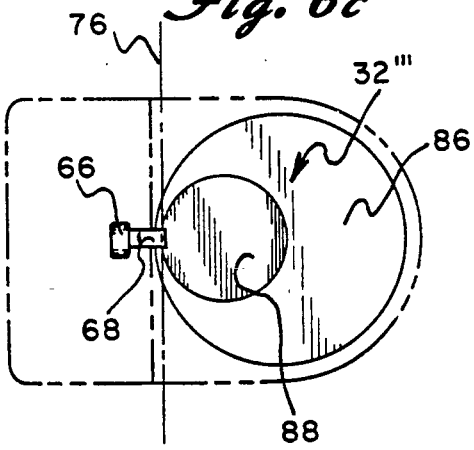
Figure 6D:
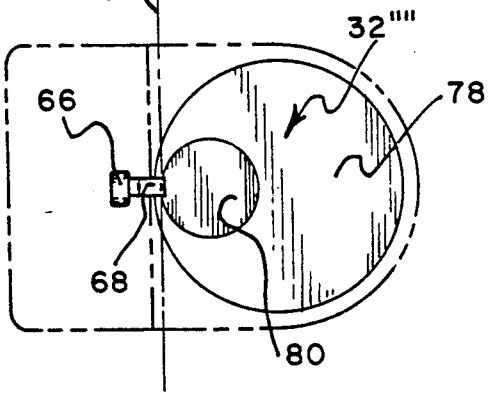
Figure 6E:
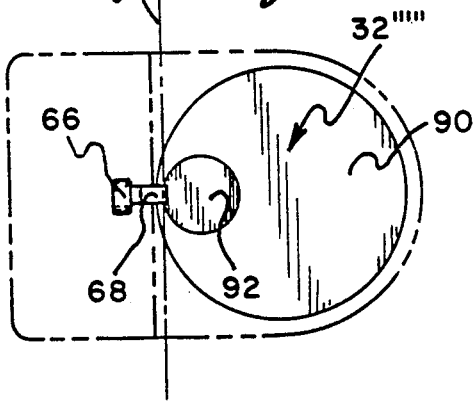

Likewise, a square pharmaceutical container can be accommodated by a square bore opening again with one side of the bore opening being positioned to engage the location of the extended sensor device. As shown in FIG. 6, versions 6*a* and 6*c* are the top views of the device as illustrated in FIGS. 2 through 5. Engagement line 76 is shown to illustrate the chosen location to which switch member 68 extends into opening 16 and, as a result of positioning of the bore opening, into that bore opening. Thus, in FIG. 6*a*, switch member 68 of microswitch 66 extends to location 76 which is within bore opening 16 of positioning device 32. In this embodiment, bore opening 16 is almost as large as opening 16 and is essentially the maximum size opening illustrated. Likewise, in FIG. 6*c*, the diagram illustrates positioning device 32' with circular bore opening 60 being about sixty-five percent of the diameter of bore opening 16. The bore opening is positioned to the front side of opening 16 so that the relative position of location 76 with respect to bore opening 60 is identical to that of 6*a*. The positioning of bore opening 60 off center of bushing 58 positions the bore opening in the proper position. Likewise, in the diagram 6*b*, positioning device 32'' through the off center positioning of circular bore opening 84 on bushing 82 allows switch member 68 to engage any container snugly fitting into opening 84 which is about eighty-five percent of the diameter of container 16. In diagrams 6*d*, *e*, and *f*, positioning devices 32''', 32'''', and 32''''', respectively provide for increasingly smaller containers. Bushings 86, 78, and 90 provide support and positioning of bore openings 88, 80 and 92, respectively, in each case positioning the bore openings so that a container sized to fit that bore opening, must of necessity trip switch member 68 of microswitch 66 at location 76.

Figure 7:
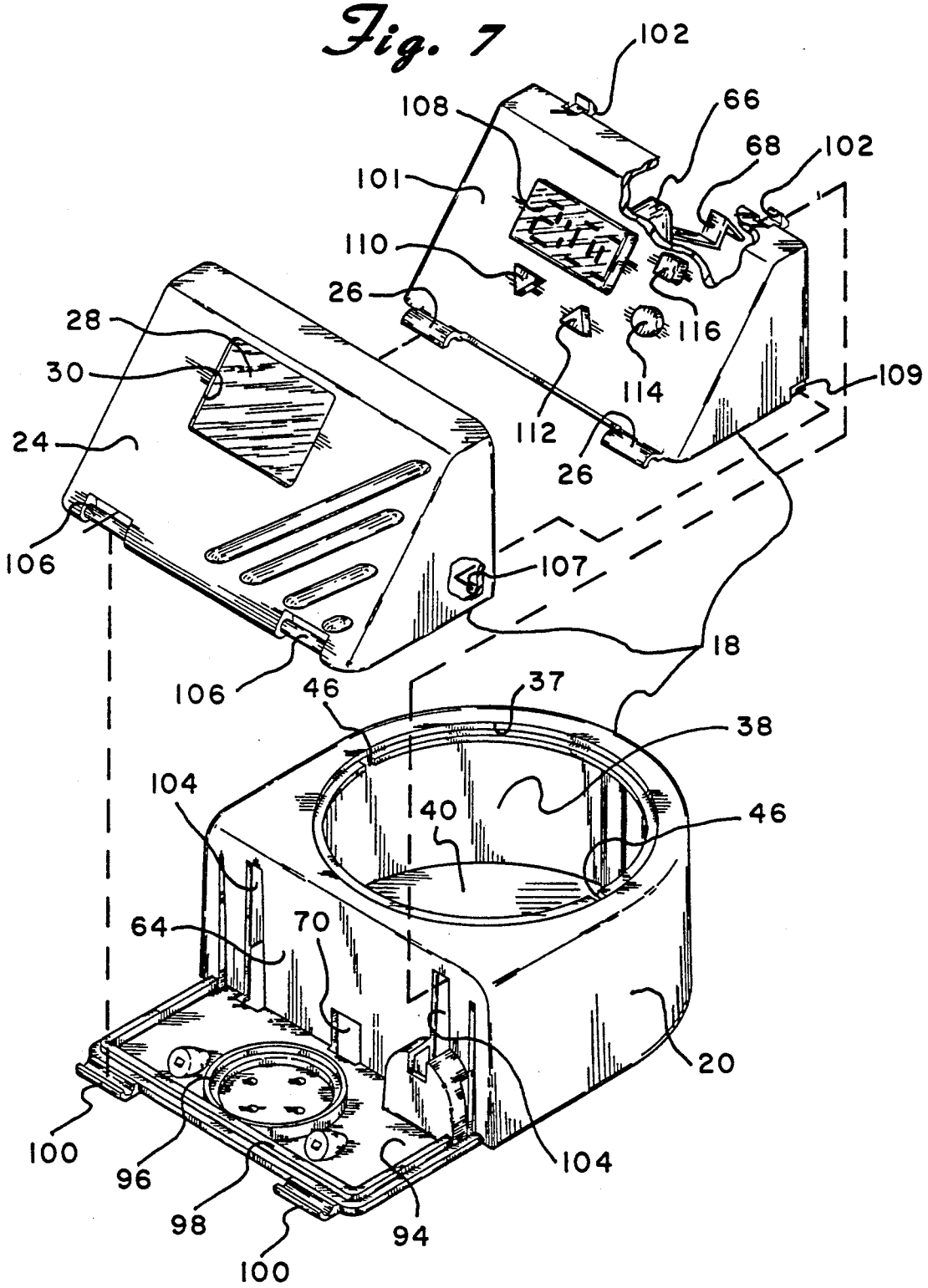
FIG. 7 is an exploded perspective view of the housing of the device illustrated in FIG. 1, partially cut away to show the signal processing and time keeping devices installed in the housing.
Figure 8:
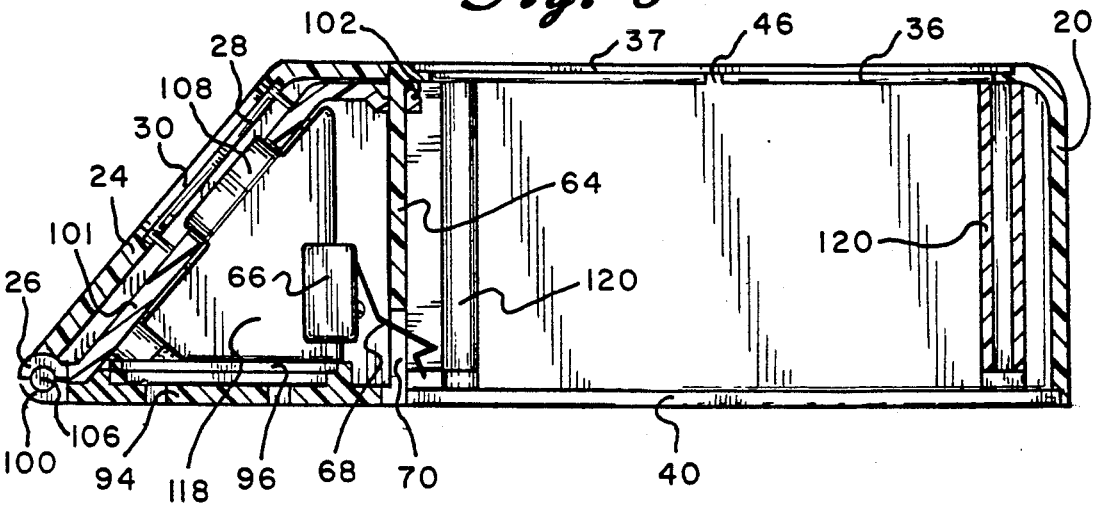
FIG. 8 is a cross-sectional view taken along lines 8—8 of FIG. 2.
Figure 9:
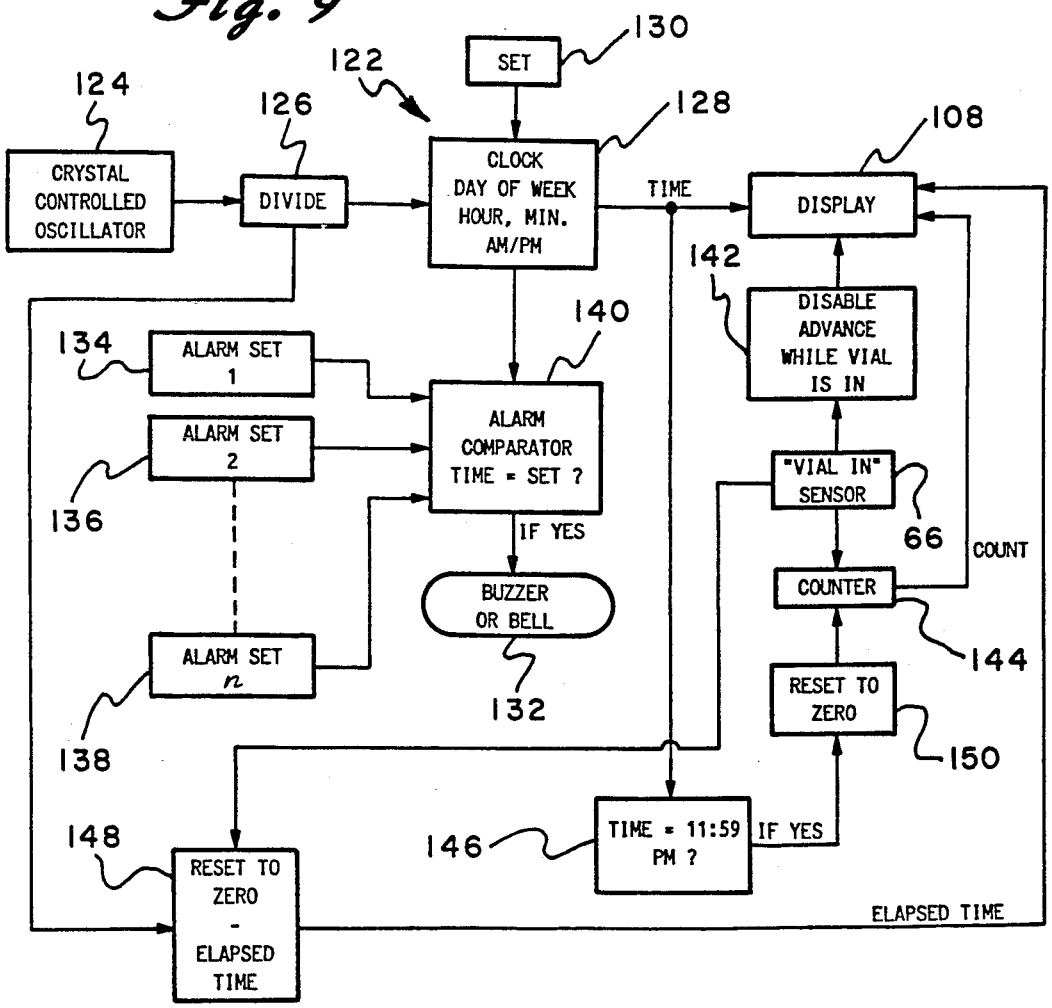
FIG. 9 is a schematic block diagram of the electronic circuitry thereof.

In FIG. 7, the parts of the housing are illustrated. These parts as well as all the positioning devices are injection molded a suitable thermoplastic polymer such as polystyrene or an engineering plastic such as a nylon. Housing 18 includes a base housing of which base section 20 is a major portion. Interior vertical wall 64 is shown through which opening 70 allows switch member 68 to operate. Front floor section 94 of this base part extends forwardly to support the electronic module described hereinbelow which includes a time keeping device, a display device, and a signal processing device with a circuit to transmit the signal that microswitch 66 has been closed to the balance of the electronic device. Electronic components rest on and are attached to housing support frame 96 on floor section 94 which is bounded by vertical frame 98. Lower hinge holders 100 extend outwardly and forwardly from floor section 94. Interior housing section 102 houses the electronic components engaging snap hook members 102 extending from the upper edge and rearwardly through slot openings 104 to snap fit housing 101 inside frame 98 to hold it in place. With inner housing 101 snapped in position, upper hinge connection covers 26 mate with lower hinge connection cover sections 100 gripping hinge pins 106 of cover 24 allowing the cover to rotate on the pins forwardly and downwardly to expose the control functions extending through the front panel of inner housing 101. Cover 24 is held in place by a raised knob 107 on the rear inside surface of a side wall of the cover engaging detent depression 109 on the outside rear of housing 101. The control function buttons in addition to display panel 108 extend through the front panel of inner housing 101. Display panel 108 displays all of the information available including the time the last medication dose was taken, the last time since that last dose and the number of times the medication was accessed and presumably taken in one day. The controls include backward or down set button 110, forward or up set button 112, reset button 114 and mode button 116. As shown in FIG. 8, time piece and signal processing device 118 rests on and is attached to floor section 94. Base 40 is adhesively attached to set away members 120. FIG. 9 illustrates the circuitry of device 118 in schematic block diagram form. The individual electronic components are well known to those skilled in the art and are of the type available in commercial electronic time keeping devices such as digital clocks and watches. Circuit 122 includes crystal controlled oscillator 124, a divide down circuit 126 and clock circuitry 128 to convert the divided down pulses to time of day, day of week, and a.m. or p.m. Also included is an appropriate means 130 to set the current time in clock 128. Circuit 122 also includes alarm 132, such as a buzzer or bell and alarm set controls 134, 136, and 138. Comparator circuit 140 compares the signal from clock 128 with the set points of 134, 136, and 138 and, if the two are identical, activates alarm 132. Micro switch 66 is the "vial in" sensor and is activated when the vial is inserted in the bore opening and a continuous circuit exists between switch member 68 and contact 72. "Vial in" sensor 66 sends a signal when the vial is in place to a display disable advance 142 which processes the signal to keep the display module 108 from changing its indication of time. Thus, when the container is in the base section of device 10, clock 128 of the time keeping device continues to keep time but display 108 is held at the last time that the container was out of the base section and the circuit between the contacts broken to correspond to the instant before the container was inserted into base section 20. This time is displayed on display 108 which, when consulted by the patient, identifies the time when the medication container was last removed to take a dosage of medicine. Alternatively, the display may indicate elapsed time since the container was last out thus indicating the time since the last dosage. The circuitry also includes counter 144 and means for displaying the count in display module 108. Module 146 looks to see if the time is 11:59 p.m. and if yes, counter 144 is reset to zero. Elapsed time module 148 maintains the time elapsed since the last removal of the medication vial and is reset to zero each time the medication container is removed from the base.

While this invention has been described with reference to the specific embodiments disclosed herein, it is not confined to the details set forth and the patent is intended to include modifications and changes which may come within and extend from the following claims.

We claim:

1. A holding device for medicine containers providing information as to when the medicine was taken to aid a patient to take the medicine in a timely manner, the device comprising:

(a) a housing having an opening of a sufficient shape and size to receive a medicine container and support it therein, (b) time keeping means in the housing to keep correct time, (c) display means on the housing to display the time when the last dosage was taken, (d) sensor means in the housing to sense when a container is placed in the opening of the housing and to provide a signal of the condition that container has been placed in the housing, and (e) circuit means to transmit the signal to, (f) signal processing means electrically connected with the time keeping means to:

(i) receive the signal from the sensor means, (ii) register the time when the medicine container was last placed in the housing, and (iii) activate the display means to display said time.

2. The device of claim 1 wherein the sensor means senses the container at a location in the opening and the device further comprises positioning means to position the container inserted in the opening such that a portion of the container must be in said location regardless of the size or shape of the container.

3. The device of claim 2 wherein the sensor means comprises a switch member extending into the opening to said location.

4. The device of claim 2 wherein the positioning means comprises:

(a) a guide member defining a inside bore with an inside size and shape to receive a specific sized and shaped container, (b) access means through the guide member to allow access of the sensing means to said location when the guide member is inserted in the opening of the housing, and (c) alignment means to align the guide member inserted into the opening to allow the sensing means to reach said location through the access means.

5. The device of claim 4 wherein the positioning means comprises a plurality of guide members each defining an inside bore with an different inside size or shape to receive a different specific sized or shaped container.

6. The device of claim 4 wherein the guide member comprises a cylindrical tube with an inside bore size and shape to receive a specific sized and shaped container.

7. The device of claim 4 wherein the alignment means comprises an integral bushing member from which the guide member depends and through which a bore opening is aligned with the inside bore of the guide member.

8. The device of claim 4 wherein the opening in the housing is upwardly vertical.

9. The device of claim 3 wherein the positioning means comprises:

(a) a cylindrical tube with the inside bore size and shape sufficient to receive a specific sized and shaped container and an aperture through the wall into the inside of the tube to receive the switch member, and (b) alignment means to hold the tube inserted into the opening to align the aperture to allow the switch member to reach said location.

10. The device of claim 9 wherein the positioning means comprises a plurality of cylindrical tubes each having an inside bore with an different inside size or shape to receive a different specific sized or shaped container.

11. The device of claim 1 wherein the signal processing means further comprises means to determine the time interval since the medicine container was last placed in the housing and to cause the display means to display same.

12. The device of claim 1 wherein the signal processing means further comprises means to determine the number of times the medicine container was placed in the housing within a chosen period of time and to cause the display means to display same.

13. The device of claim 1 wherein the time keeping means further comprises alarm means to set time when the medicine should next be taken and indicating to the patient when that time is reached.

14. A holding device for medicine containers providing information as to when the medicine was taken to aid a patient to take the medicine in a timely manner, the device comprising:

(a) a housing comprising a base section having an opening of a sufficient shape and size to receive a medicine container in the base section and be supported therein, (b) time keeping means in the enclosure section to keep correct time, (c) display means on the housing to display the time when the last dosage was taken, (d) sensor means in the base section to sense at a location in the opening when a container is placed in the opening of the base section and to provide a signal of the condition that a container has been placed in the base section, (e) positioning means to position the container inserted in the opening such that a portion of the container must be in said location regardless of the size or shape of the container, and (f) circuit means to transmit the signal to, (g) signal processing means connected with the time keeping means to:

(i) receive the signal from the sensor means, (ii) register the time when the medicine container was last placed in the base section, and (iii) activate the display means to display said time.

15. The device of claim 14 wherein the sensor means comprises a switch member extending into the opening to said location.

16. The device of claim 14 wherein the positioning means comprises:

(a) a guide member defining a inside bore with an inside size and shape to receive a specific sized and shaped container, (b) access means through the guide member to allow access of the sensing means to said location when the guide member is inserted in the opening of the base section, and (c) alignment means to align the guide member inserted into the opening to allow the sensing means to reach said location through the access means.

17. The device of claim 16 wherein the positioning means comprises a plurality of guide members each defining an inside bore with an different inside size or shape to receive a different specific sized or shaped container.

18. The device of claim 16 wherein the guide member comprises a cylindrical tube with an inside bore size and shape to receive a specific sized and shaped container.

19. The device of claim 16 wherein the aligment means comprises an integral bushing member from which the guide member depends and through which a bore opening is aligned with the inside bore of the guide member.

20. The device of claim 16 wherein the opening in the base section is upwardly vertical.

21. The device of claim 14 wherein the signal processing means further comprises means to determine the time interval since the medicine container was last placed in the housing and to cause the display means to display same.

22. The device of claim 14 wherein the signal processing means further comprises means to determine the number of times the medicine container was placed in the housing within a chosen period of time and to cause the display means to display same.

23. The device of claim 14 wherein the time keeping means further comprises alarm means to set time when the medicine should next be taken and indicating to the patient when that time is reached.

24. A method to aid a patient to take the medicine in a timely manner providing information as to when the medicine was taken, the method comprising:

(a) providing a housing having an opening of a sufficient shape and size to receive a medicine container and support it therein, (b) providing time keeping means in the housing to keep correct time, (c) providing display means on the housing to display the time when the last dosage was taken, (d) providing sensor means in the housing to sense when a container is placed in the opening of the housing and to provide a signal of the condition that a container has been placed in the housing, (e) providing circuit means to transmit the signal to, (f) signal processing means which is provided electrically connected with the time keeping means to:

(i) receive the signal from the sensor means, (ii) register the time when the medicine container was last placed in the housing, and (iii) activate the display means to display said time, (g) inserting a medicine container into the opening in the housing after taking the medicine, and (h) reading the time on the display means as being when the medicine was last taken.

25. The method of claim 24 further comprising:

(a) providing positioning means that comprises:

(i) a guide member defining a inside bore with an inside size and shape to receive a specific sized and shaped container, (ii) access means through the guide member to allow access of the sensing means to said location when the guide member is inserted in the opening of the housing, and (iii) alignment means to align the guide member inserted into the opening to allow the sensing means to reach said location through the access means, (b) inserting the positioning means into the opening of the housing prior to inserting the container, and (c) inserting a medicine container into the inside bore in the guide member after taking the medicine.

26. The method of claim 25 further comprising:

(a) providing a plurality of guide members each defining an inside bore with an different size or shape to receive a different specific sized or shaped container, and (b) choosing a guide member having an inside bore corresponding to the medicine container to be used.

* * * * *